US009328628B2

(12) United States Patent
Schenkenberger et al.

(10) Patent No.: US 9,328,628 B2
(45) Date of Patent: May 3, 2016

(54) BEARING HOUSING OF AN EXHAUST-GAS TURBOCHARGER

(75) Inventors: Niclas Schenkenberger, Mainz (DE); Johannes Hornbach, Frankenthal (DE)

(73) Assignee: BorgWarner Inc., Auburn Hills, MI (US)

( * ) Notice: Subject to any disclaimer, the term of this patent is extended or adjusted under 35 U.S.C. 154(b) by 564 days.

(21) Appl. No.: 13/816,503

(22) PCT Filed: Aug. 18, 2011

(86) PCT No.: PCT/US2011/048206

§ 371 (c)(1),
(2), (4) Date: Feb. 12, 2013

(87) PCT Pub. No.: WO2012/027183

PCT Pub. Date: Mar. 1, 2012

(65) Prior Publication Data

US 2013/0183144 A1 Jul. 18, 2013

(30) Foreign Application Priority Data

Aug. 24, 2010 (DE) ..... 10 2010 035 281

(51) Int. Cl.

| | |
|---|---|
| ***F01D 25/16*** | (2006.01) |
| ***F01D 25/24*** | (2006.01) |
| ***F04D 25/02*** | (2006.01) |
| ***F04D 29/056*** | (2006.01) |

(52) U.S. Cl.

CPC ..... *F01D 25/16* (2013.01); *F01D 25/162* (2013.01); *F01D 25/24* (2013.01); *F04D 25/02* (2013.01); *F04D 25/024* (2013.01); *F04D 29/056* (2013.01); *F05D 2220/40* (2013.01)

(58) Field of Classification Search

CPC ..... F01D 25/16; F01D 25/162; F01D 25/24; F04D 25/02; F04D 25/024; F04D 29/056; F05D 2220/40

See application file for complete search history.

(56) References Cited

U.S. PATENT DOCUMENTS

| | | | | |
|---|---|---|---|---|
| 6,126,414 | A * | 10/2000 | Koike | F01D 25/168 417/407 |
| 7,837,448 | B2 * | 11/2010 | Shimizu | F01D 11/003 417/407 |
| 8,001,781 | B2 * | 8/2011 | Shibui | F02B 37/10 417/374 |
| 2010/0139270 | A1 * | 6/2010 | Koch | F01D 25/16 60/605.3 |

* cited by examiner

*Primary Examiner* — Igor Kershteyn

(74) *Attorney, Agent, or Firm* — A. Michael Tucker; Stephan A. Pendorf; Patent Central LLC

(57) ABSTRACT

A bearing housing (1) of an exhaust-gas turbocharger, having a housing body (2) in which an axial bearing (3) is arranged, and a compressor-side housing cover (4) which can be fixed in a compressor-side housing opening (6) via a fastening device (5). The fastening device (5) is a non-positively locking fastening device.

8 Claims, 2 Drawing Sheets

BEARING HOUSING OF AN EXHAUST-GAS TURBOCHARGER

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR BY A JOINT INVENTOR

Not Applicable.

BACKGROUND OF THE INVENTION

1. Field of the Invention

The invention relates to a turbocharger turbine.

2. Description of the Related Art

Bearing housings of said type have a housing cover which, in the case of a known design, is fixed to the housing body of the bearing housing by means of a screw connection or a positively locking tapered ring connection.

In contrast, it is an object of the present invention to provide a bearing housing whose components can be assembled in a time-saving and simple manner.

BRIEF SUMMARY OF THE INVENTION

The fact that the fastening device acts in a non-positively locking manner results in time-saving, screw-free and simple assembly of the components of the bearing housing.

The subclaims relate to advantageous refinements of the invention.

Aside from the time-saving, screw-free and simple assembly of the housing cover on the bearing housing body, a further result is likewise simple assembly of the axial bearing and the possibility of expedient production of the components, because simple geometries can be selected for these.

Furthermore, a relatively large volume for the collection and discharge of the oil is obtained in the oil free space of the housing cover on account of the small spatial requirement of the housing cover as a result of the connecting elements not being required.

BRIEF DESCRIPTION OF THE SEVERAL VIEWS OF THE DRAWINGS

Further details, advantages and features of the present invention will emerge from the following description of an exemplary embodiment on the basis of the drawing, in which.

DETAILED DESCRIPTION OF THE INVENTION

Figure 1:
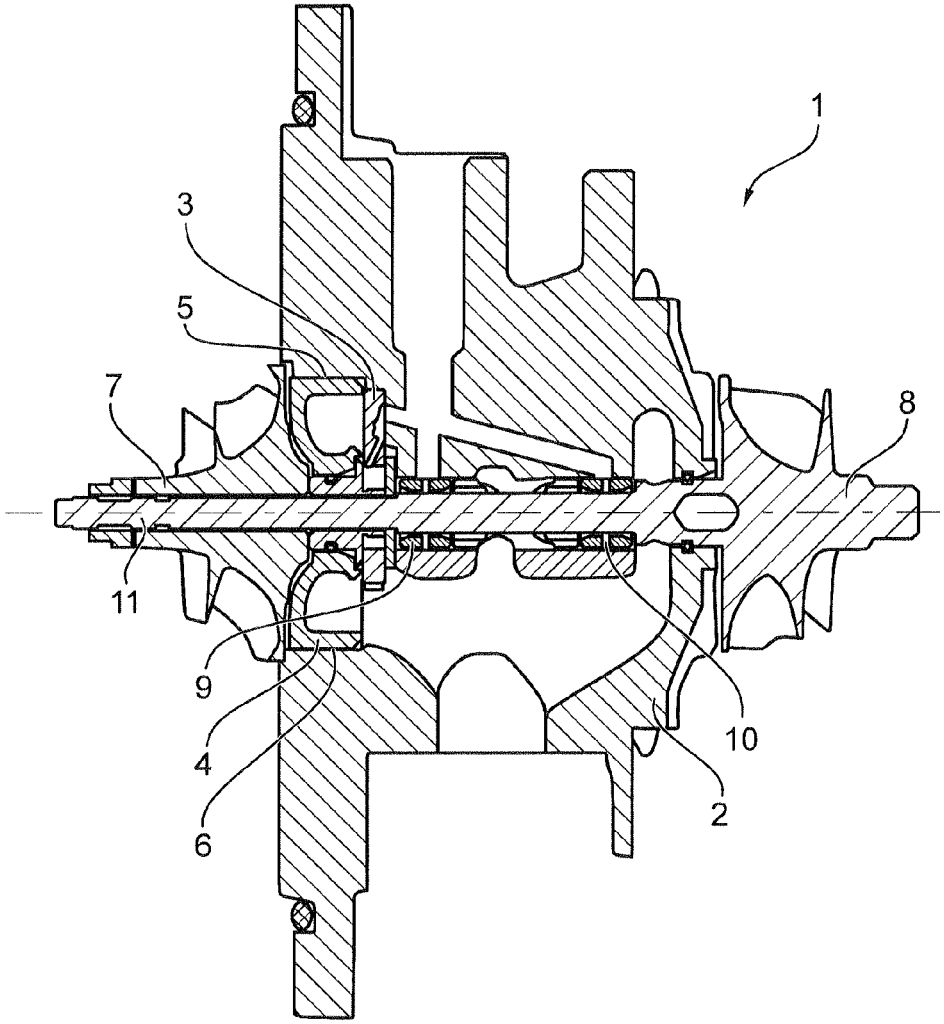
FIG. 1 shows a schematically simplified view of a bearing housing body group of an exhaust-gas turbocharger which is provided with the bearing housing according to the invention.

FIG. 1 shows a bearing housing I according to the invention in the installed state in a bearing housing body group of an exhaust-gas turbocharger. Said body group has, in addition to the bearing housing 1 with its housing body 2 and an axial bearing 3, a compressor-side housing cover 4 which, in the assembled state illustrated in FIG. 1, closes off a housing opening 6, for which purpose the housing cover 4 can be fixed by means of a fastening device 5 which will be described below in more detail on the basis of FIGS. 2 to 4.

The body group also has a compressor wheel 7, a turbine wheel 8, a compressor-side bearing arrangement 9, a turbine-side bearing arrangement 10 and a shaft 11 on which the compressor wheel 7 and the turbine wheel 8 are mounted. If a compressor housing and a turbine housing, which are not illustrated in FIG. 1, and possibly further attachment elements are added to said body group, this yields an exhaust-gas turbocharger with the conventional components, which however need not be described in detail for the purpose of explaining the present invention.

Figure 2:
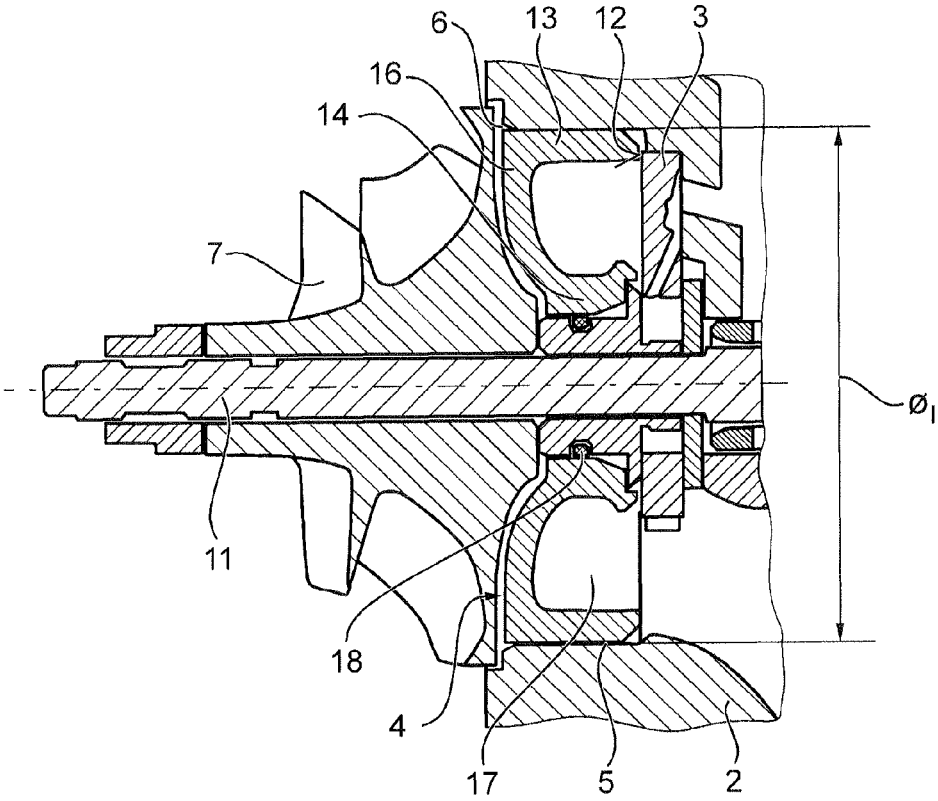
FIG. 2 shows a schematically simplified illustration of a housing cover according to the invention in the state in which it is mounted on the bearing housing.

FIG. 2 shows, in an enlarged illustration, the housing body 2 of the bearing housing 1 and the housing cover 4 in the state in which it has been installed into the housing opening 6. The fastening device is designed as a non-positively locking fastening device 5, such that the fixing of the housing cover 4 can take place in an extremely simple manner by virtue of the housing cover 4 being pressed into the housing opening 6. The housing cover 4 preferably has for this purpose an outer diameter $\phi_A$ which is larger than the inner diameter $\phi_I$ of the housing opening 6. It is particularly preferable here for the housing cover 4 to be composed of material that can be deformed when said housing cover is pressed in, for example of sheet metal.

After the mounting of the housing cover 4 in the housing body 2 of the bearing housing 1, said housing cover bears against the axial bearing 3, as can be seen from FIG. 2. In said position, said housing cover holds the axial bearing 3 fixed without further components. For this purpose, the axial bearing 3 has an abutment surface 12 which faces toward the housing opening 6 and with which the housing cover 4 comes into engagement after being inserted into the housing opening 6.

Figure 3:
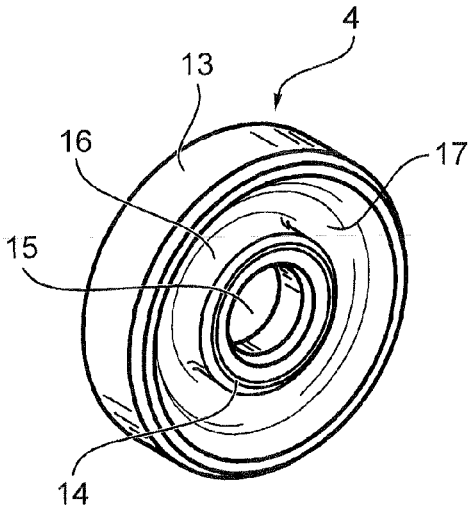
FIGS. 3 and 4 show perspective illustrations of a rear and front side, respectively, of the housing cover according to the invention.
Figure 4:
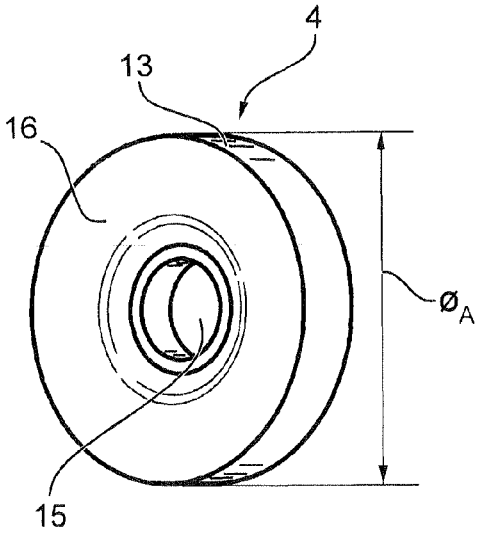

As can be seen from a juxtaposition of FIGS. 2 to 4, the housing cover 4 has an outer retaining ring 13 and, arranged concentrically with respect thereto, an inner shaft passage ring 14 which delimits a shaft passage opening 15. As is shown by the juxtaposition of FIGS. 2 and 3, the retaining ring 13 and the shaft passage ring 14 delimit an oil free space 17 into which the oil centrifuged from a seal bush of the compressor-side bearing arrangement 9 can pass without resistance and be discharged. The static sealing may take place directly between the bearing housing body 2 and the housing cover 4 or by means of an O-ring 18 or similar sealing devices.

Even though secure fixing of the housing cover 4 in the housing opening 6 is possible without further components, it is possible in principle for further assistive means to be provided which further improve the connection stability and sealing action. These may be for example friction-promoting structures (such as for example roughened portions) on the outer surface of the outer ring 13, or else an additional positively locking connecting device, though these are not shown in detail in the figures.

in addition to the above written disclosure of the invention, reference is hereby explicitly made to the diagrammatic illustration of the invention in the figure.

LIST OF REFERENCE SYMBOLS

1 Bearing housing
2 Housing body
3 Axial bearing
4 Housing cover
5 Fastening device
6 Housing opening
7 Compressor wheel
8 Turbine wheel
9 Compressor-side bearing arrangement
10 Turbine-side bearing arrangement
11 Shaft
12 Abutment surface
13 Retaining ring
14 Shaft passage ring
15 Shaft passage recess
16 End wall
17 Oil free space
18 O-ring
$\square_I$ Inner diameter
$\square_A$ Outer diameter

The invention claimed is:

1. A bearing housing (1) of an exhaust-gas turbocharger, having a housing body (2) in which an axial bearing (3) is arranged, and a compressor-side housing cover (4) which can be fixed in a compressor-side housing opening (6) by means of a fastening device (5), wherein the fastening device (5) is a non-positively locking fastening device.

2. The bearing housing as claimed in claim 1, wherein the housing cover (4) has an outer diameter $\phi_A$, wherein the bearing housing (1) has an abutment surface (12) adapted for abutment contact with said housing cover (4), and wherein said housing cover (4) bears with it's outer diameter (100 $_A$) against the abutment surface (12).

3. The bearing housing as claimed in claim 2, wherein the housing cover (4) has a retaining ring (13) and a concentric inner shaft passage ring (14), which rings are connected to one another via an end wall (16).

4. The bearing housing as claimed in claim 3, wherein the retaining ring (13), the shaft passage ring (14) and the end wall (16) delimit an oil free space (17).

5. The bearing housing as claimed in claim 3, wherein the retaining ring (13) is provided with a friction-promoting roughened portion on the outer circumference of ring (13).

6. The bearing housing as claimed in claim 1, wherein the housing cover (4) is a sheet-metal part.

7. The bearing housing as claimed in claim 1, wherein a sealing element (18) is provided between the bearing housing body (2) and the housing cover (4).

8. The bearing housing as claimed in claim 1, wherein a positively locking fastening device is additionally provided between the bearing housing body (2) and the housing cover (4).

* * * * *